US006196600B1

(12) United States Patent
Miller

(10) Patent No.: US 6,196,600 B1
(45) Date of Patent: Mar. 6, 2001

(54) ANIMAL WASTE SCOOPING AND DISPOSAL DEVICE

(76) Inventor: Brooke Daniel Miller, 1212 E. Haven Dr., Anaheim, CA (US) 92805

( * ) Notice: Subject to any disclaimer, the term of this patent is extended or adjusted under 35 U.S.C. 154(b) by 0 days.

(21) Appl. No.: 09/443,053

(22) Filed: Nov. 18, 1999

(51) Int. Cl.[7] ..... A01K 29/00; E01H 1/12
(52) U.S. Cl. ..... 294/1.4; 15/257.7; 294/53.5
(58) Field of Search ..... 294/1.3–1.5, 53.5, 294/55; 15/104.8, 257.1–257.4, 257.6, 257.7

(56) References Cited

U.S. PATENT DOCUMENTS 959,926 * 5/1910 Feld et al. ..... 15/257.7
3,827,098 * 8/1974 Sanderson ..... 294/1.4
4,005,892 * 2/1977 Williams ..... 294/1.4
4,222,597 * 9/1980 Willis ..... 294/1.4
4,316,627 * 2/1982 Solypa ..... 294/55 X
4,447,082 * 5/1984 Lindholm ..... 294/1.4
5,033,781 * 7/1991 Flood ..... 294/1.4

* cited by examiner

*Primary Examiner*—Johnny D. Cherry
(74) *Attorney, Agent, or Firm*—Stout, Uxa, Buyan & Mullins LLP

(57) ABSTRACT

An animal waste scooping and disposal device with a replaceable disposable bag mounted on the rear of the scooping tray is disclosed. This disposable bag, coupled with the pivoting tray, enables the user to collect several different areas of animal waste before having to change the bag.

20 Claims, 5 Drawing Sheets

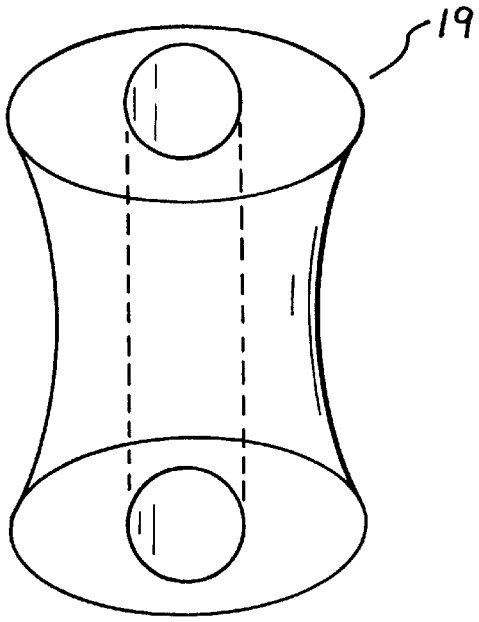
Fig. 1b
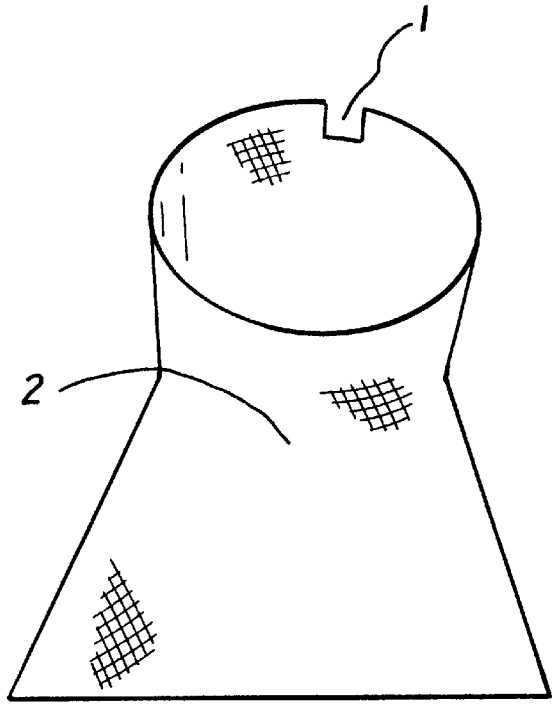
Fig. 7
Fig. 6
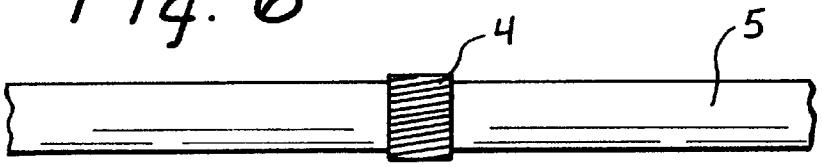

ANIMAL WASTE SCOOPING AND DISPOSAL DEVICE

BACKGROUND OF THE INVENTION

1. Field of the Invention

The present invention relates to waste collection and disposal devices.

2. Description of Related Art

Devices for collecting and disposing of animal waste have existed in the prior art. These prior-art devices are typically designed to collect, carry, and immediately dispose of the animal waste. Prior-art devices do not facilitate transportation of the contents to the nearest disposal area, or in some cases back to a user's home, without dropping or spilling of a portion of the contents.

Prior-art devices typically should be emptied after each use. Coverless waste scooping and disposal devices are designed to leave the waste exposed so that a user walking a disobedient dog cannot easily control the animal and prevent the waste from falling out of a scooping tray of the device. Prior-art devices are not designed to stand in an upright position without the assistance of the user.

To set a filled prior art scooper device down, a user must lean the device against an object to enable the device to stand in an upright position. Because conventional devices do not have pivoting and locking trays, a user's only option for setting down the device is the leaning of the conventional device against an object to avoid spilling the contents.

Typical prior-art devices are not designed with temporary locking devices for holding pivoting scooping trays in stationary positions during emptying of the devices. Because this flaw exists in these devices, the assistance of a second hand is needed to hold the tray in a position that would allow the waste to fall out.

Although separate raking devices have existed in the prior art for assisting the user in raking the waste into the tray, these raking devices must be carried separately. Existing scooping devices do not have any type of clip-on device for attaching the rake to the handle of the scooping device. Therefore, it has been necessary for the user to hold their animal, the scooping device, and the portable rake all at the same time.

Prior art scooping and disposal devices have suffered from one or more of the following disadvantages:

(a) They are not designed to hold more than several ounces of animal waste before having to be emptied.

(b) They do not provide a secure holding area, that would prevent spilling when transporting the waste to a disposal area.

(c) They do not provide a covered or secured area for the animal waste. This can be an embarrassing, as well as unsanitary way of carrying animal waste.

(d) They do not provide a temporary locking device for holding the tray in a position that would allow the waste to fall out when emptying.

(e) The user often must physically place his or her bare hand on the waste-covered tray to empty the contents.

(f) They are not designed to stand in an upright position without the assistance of the user.

(g) They do not provide an easy and effective way of disposing of animal waste.

(h) They do not provide a sanitary and clean way of disposing of animal waste.

SUMMARY OF THE INVENTION

Several objects and advantages of the prevent invention are:

(a) Provides a more convenient way of carrying both rake and waste scooping device.

(b) An attached disposable bag provides a sanitary means of acquiring and disposing of animal waste.

(c) The attached disposable bag provides a secure means for transporting the animal's waste once it has been picked up.

(d) Provides extended fork on the front of the scooping tray to assist the user in collecting waste in deep grass or weeded areas.

(e) Provides a quick and easy way of disposing of animal waste.

(f) Provides a temporary locking device to hold the tray in a desired position, when collecting animal waste on steep inclines.

(g) Provides a spill-proof means for collecting, transporting and disposing of animal waste.

(h) The disposable bag provides a cleaner way of disposing of animal waste by preventing waste from spilling, or sticking to the inside walls of the disposal area.

Further objects and advantages include a combination of the pivoting tray and attached disposable bag. After the user has collected the waste and lifted the entire device off of the ground as one would do in a carrying position, the weight of the attached disposable bag automatically tilts the tray in an upward position. This forces the waste to fall into the bag. This reduces a need to immediately find a disposal area.

This waste scooping and disposal device may save animal shelters money by reducing the amount of time employees spend cleaning animals' cages. This device may shorten the arena cleaning time at dog shows. This device may also assist K-9 dog training schools. This device may save time and energy, by reducing the amount of trips back and forth to waste disposal areas.

The present invention, together with additional features and advantages thereof, may best be understood by reference to the following description taken in connection with the accompanying illustrative drawings.

BRIEF DESCRIPTION OF THE DRAWINGS

FIG. 1*b* is an elevational view of an exemplary swivel used to pivotally couple two holding arms to the side of a tray in the animal waste scooping device of FIG. 1.

FIG. 6 illustrates a front-view of the bag holding clamp, hinge area.

FIG. 7 illustrates the notched out area, in the disposable bag, that will fit around the hinge area of the bag holding clamp.

DETAILED DESCRIPTION OF THE PRESENTLY PREFERRED EMBODIMENTS

Figure 1:
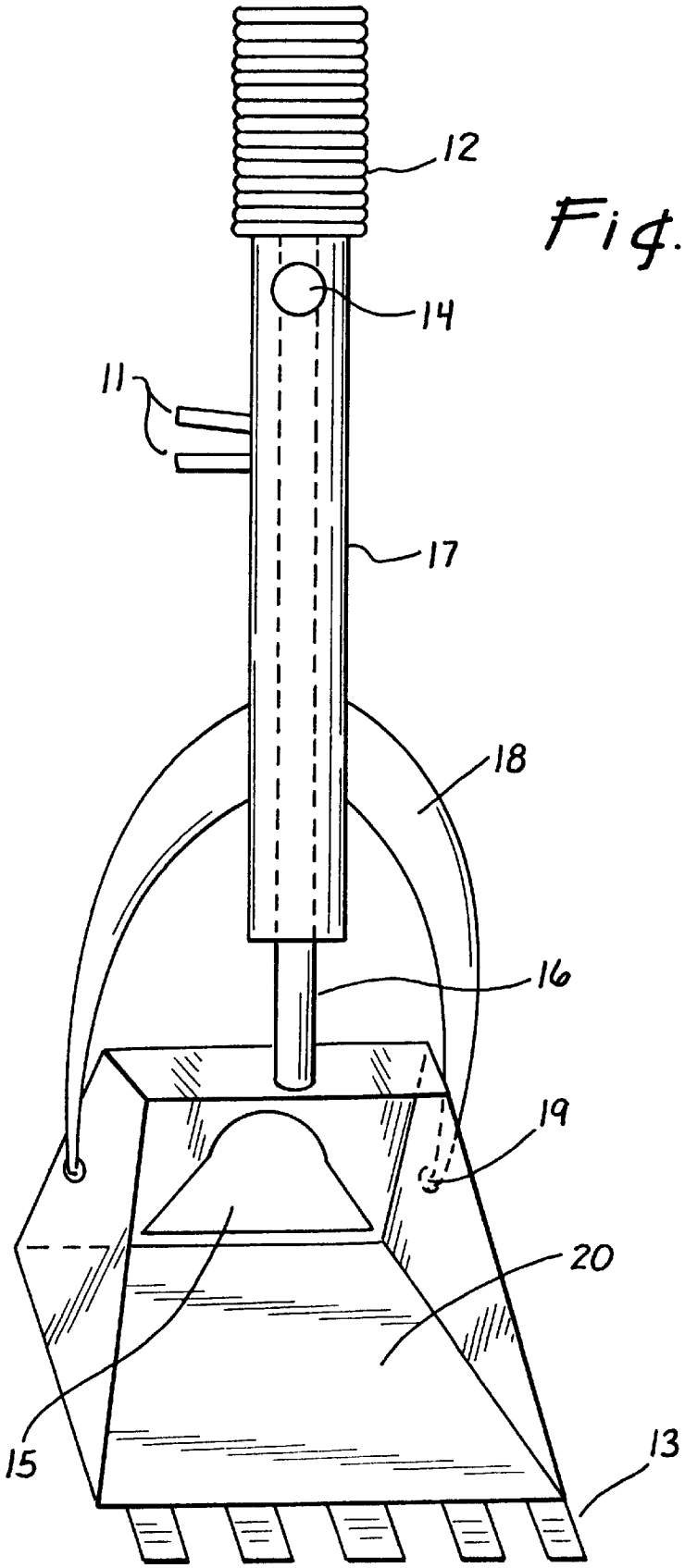
FIG. 1 illustrates a front-view of the animal waste scooping device.
Figure 1A:
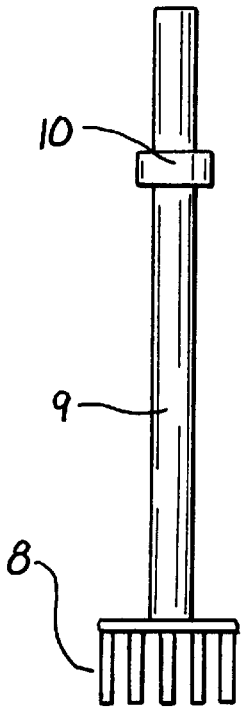
FIG. 1*a* illustrates a front-view of the attached clip-on rake.
Figure 4:
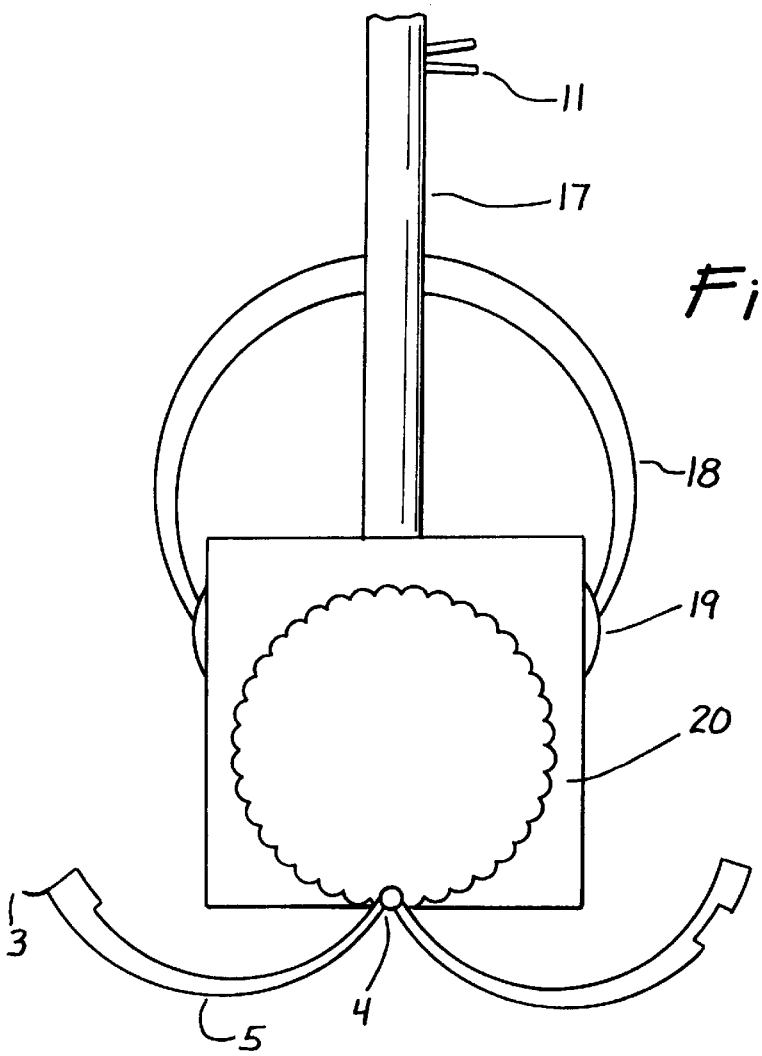
FIG. 4 illustrates a rear-view of the stationary disposable bag holding clamp in an open position.
Figure 5:
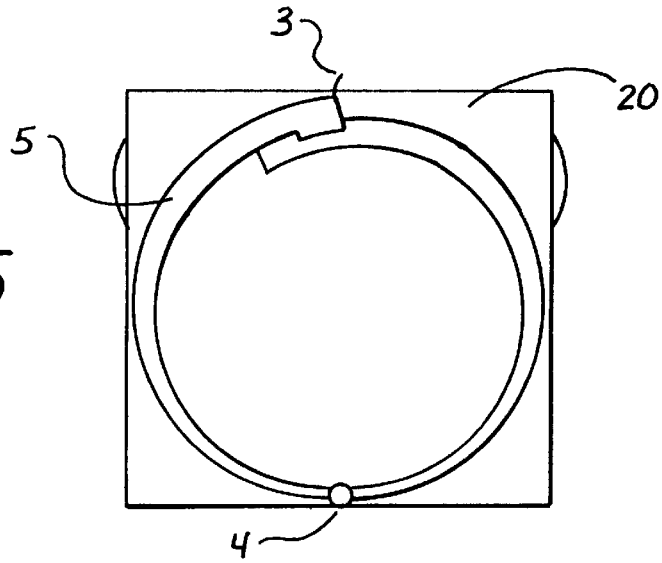
FIG. 5 illustrates a rear-view of the stationary disposable bag holding clamp in a closed position.
Figure 8:
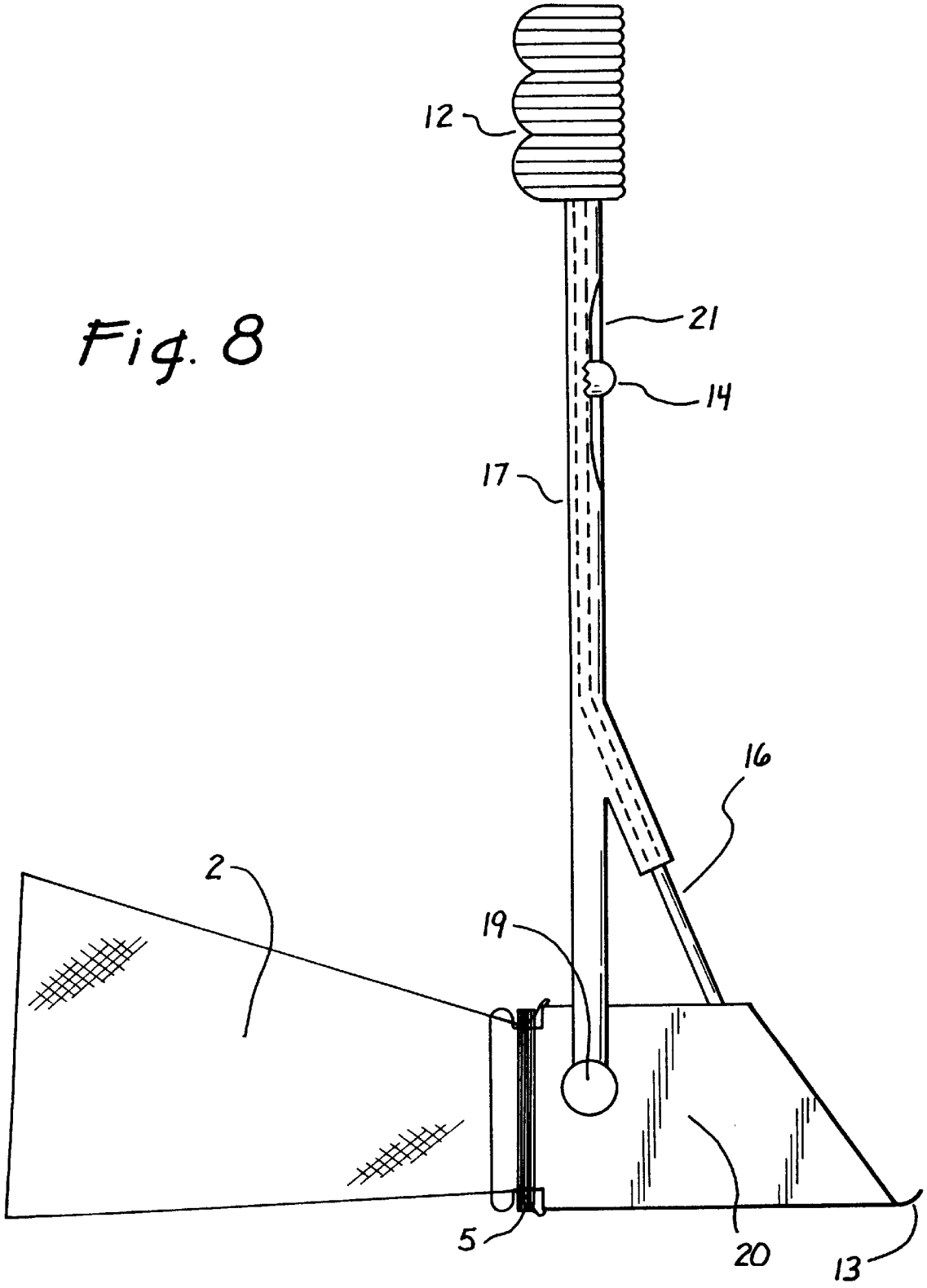
FIG. 8 illustrates a side-view of the complete unit or invention.

A typical embodiment of the animal waste scooping and disposal invention is illustrated in FIG. 1 (front-view), FIGS. 4 and 5 (rear-view), and FIG. 8 (side-view). The embodiment consists of two plastic poles 16, 17 attached to a light-weight aluminum tray 20. The tray 20 has an attached disposable bag 2 (FIGS. 7 and 8). Both of the poles 16, 17 are attached to the tray 20. The poles 16, 17 are designed to fit into each other. The larger outer pole 17 is hollowed out just enough to allow the smaller inner pole 16 to slidably fit within the larger outer pole 17. The base of the larger outer pole 17 is attached to the tray 20 by two holding arms 18.

Figure 2:
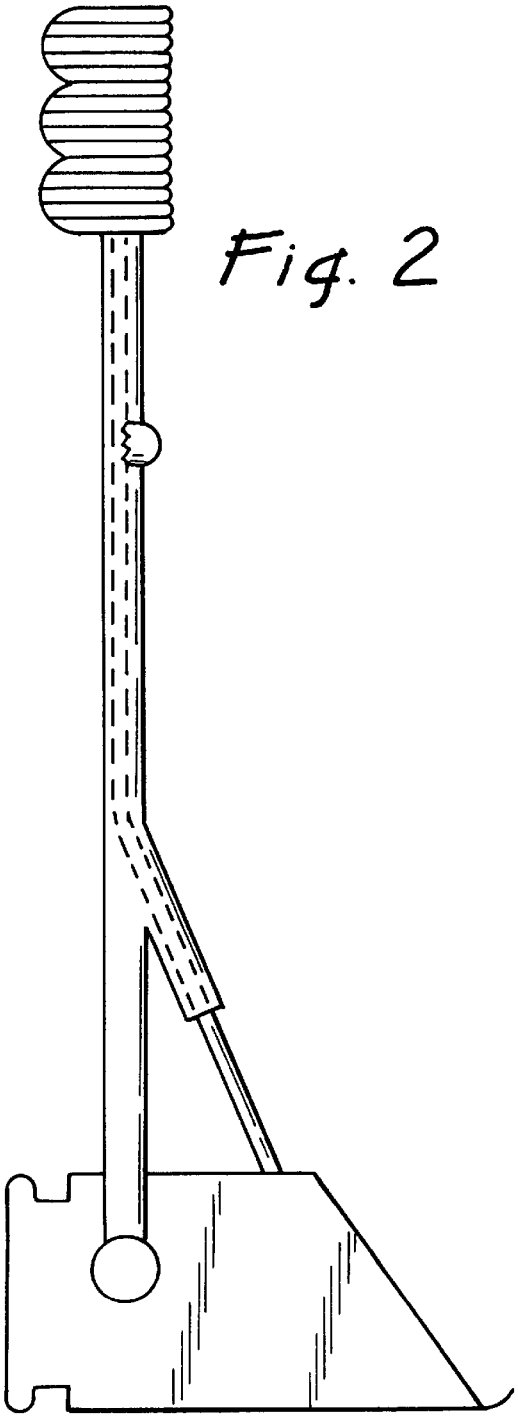
FIG. 2 illustrates a side-view of the scooping device without the attached disposable bag.
Figure 3:
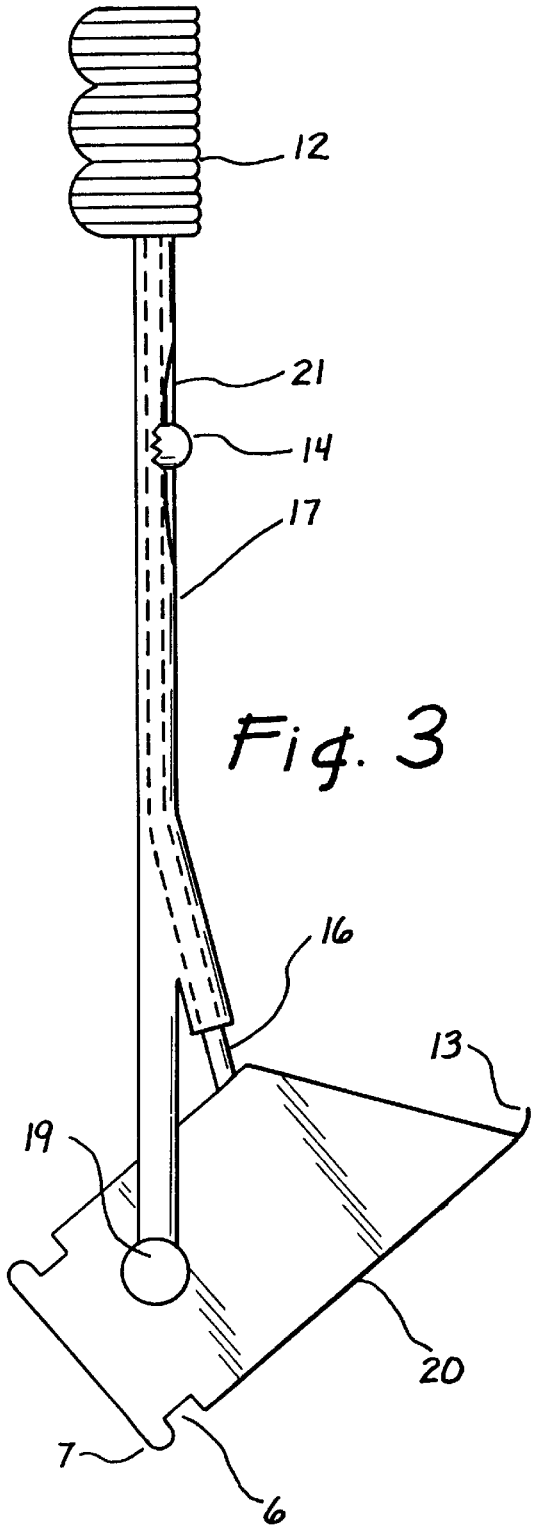
FIG. 3 illustrates a side-view in a tilted position to illustrates the tilting degree of this invention with the weight of the bag.

Each of the two holding arms 18 is attached to a side of the tray 20. Metal oval shaped swivels 19, as seen in FIG. 1*b*, are used between the tray 20 and the side holding arms 18. These swivels 19 allow the tray 10 to pivot. The smaller inner pole 16 is attached to the top front portion of the tray 20. As the tray 20 pivots up and down, it moves the inner pole 16 in and out of the larger outer pole 17. The tray 20 is designed with a waste exiting window 15. FIGS. 2 and 3 illustrate side views of the presently preferred embodiment without the disposable bag 2 being attached. After the disposable bag 2 is attached, the waste is placed inside of the tray 20, the tray 20 will automatically tilt to an upward position. This will force the waste to fall through the waste exiting window 15 into the attached disposable bag. The disposable bag 2 is attached to the rear of the tray 20 by a clamp 5 (FIG. 4).

This clamp 5 is designed with a hinge 4 and is permanently mounted to the tray 20 by a hinge 4 center pin area. FIG. 6 illustrates a front-view of the bag holding clamp, hinge area. This allows the clamp 5 to open and close freely. The ends of the clamp 5 are designed to lock onto each other once the disposable bag 2 is attached. The disposable bag 2 is designed with a cutout notched area 1 (FIG. 7). This notched area 1 fits around the hinge 4 area of the clamp 5. This provides a more secure fit for the disposable bag 2. Other bag configurations and other securing means are possible in modified embodiments.

The front lower portion of the tray 20 is designed with extended forks 13. These forks 13 enable the user to collect animal waste in deep grass or weeded areas. The end of the clamp 5 is designed with an extended finger tab 3. This finger tab 3 when pressed in an upward and outward motion, will force the clamp 5 to open. After the disposable bag 2 has been replaced, the two ends of the clamp 5 can be squeezed together until they lock together.

The upper handle portion 12 of this invention is designed with a half corrugated locking tray button 14 protruding half way through the outer pole 17. As shown in FIGS. 3 and 8, attached to this button 14 is a tension resistant clip 21. This tension resistant clip 21 is manufactured and mounted to the inner portion of the outer pole 17. Once the tray locking button 14 is pressed and held, the corrugated portion of this button 14 presses up against the smaller inner pole 16 and prevents it from moving. Because the smaller inner pole 16 is attached to the front top portion of the tray 20 using conventional means, and both the tray 20 and the smaller inner pole 16 movements are commensurate, a user can hold the scooping tray 20 in a desired position.

Once the tray locking button 14 is released, it is automatically retracted to an open position. This retracting action of the tray locking button 14 is achieved by the attached tension resistant clip 21 mounted to the button 14. This invention is designed with a rubber carrying handle 12. This invention is also designed with an attached portable rake 9. The rake 9 has a plastic male clip-on device 10 mounted toward the top of the handle 12. The waste scooping device as illustrated in FIG. 1 comprises a two prong female clip-on device 11 mounted on the side of the outer pole 17. The extended prongs 11 are made of a tension resistant metal. As the male rake clip-on device 10 is pressed on the female rake clip-on device 11, the female clip-on device 11 grips and holds the male clip-on device 10 in a secure position. This allows the user to carry both the scooping device of FIG. 8 and the portable rake 9 in one hand.

The size and shape of this invention can be designed to accommodate various people and applications. This invention can be designed to any size or shape that would accommodate larger or smaller animals. The handle on this invention can be made of any material that would provide a comfortable means for carrying the device. The poles or pipes used for this invention can be made of any durable and/or light-weight material that would stand up to repetitive use such as plastic, rubber, metal, aluminum, fiber glass, etc. The scooping tray can be made of any material that is durable enough for repetitive use such as plastic, rubber, metal, aluminum, fiberglass, etc. The swivels 19 of this invention can be made of any material such as plastic, rubber, metal, aluminum, fiberglass, etc. The attached disposable rake can be made of any material such as plastic, rubber, metal, fiberglass, etc. The male and female clips for holding the raking device on the side of the scooping device, can be made of any material such as plastic, rubber, metal, aluminum, fiberglass, etc.

The waste exiting window formed in the rear portion of the scooping tray can be of any size or shape such as oval, circular, trapezoidal, triangular, lines, squares, etc., and can be manufactured with a spring loaded tray door, that would automatically close after the waste has passed therethrough. The disposable bags can be manufactured to that of any shape or sizes known. The disposable bags can be manufactured of any material known from cloth, plastic, rubber, canvas, etc., and can be of a bio-degradable material or any other material known.

From the previously described statements, a number of advantages of the animal waste scooping and disposal device become evident:

(a) Provides convenience and freedom to a user from having to immediately find a disposal area.

(b) Provides a convenient way for carrying both rake and waste disposal device.

(c) Provides a spill proof means for collecting, transporting and disposing of animal waste.

(d) Provides a sanitary and clean means for disposing of animal waste.

(e) Provides a disposable bag to attenuate odors inside disposal areas i.e., trash cans, etc.

(f) Provides a secure way of carrying animal waste for joggers and runners.

The manner of using the animal waste scooping and disposal device comprises the following steps:

(a) Hold the handle 12 in an upright position.

(b) Set the tray 20 flat on the ground so that the opening of the tray 20 is facing the waste that is to be collected.

(c) Remove the attached portable rake 9.

(d) Using the same hand to hold the handle 12, position your thumb over the tray locking button 14 and push it in.

(c) While depressing the button 14, grab the portable rake 9.

(f) Rake the waste fully into the tray 20.

(g) After the waste has been scooped into the tray 20, reattach the portable rake 9.

(h) Lift the entire device above the ground.

(I) Once the entire device has been lifted off of the ground, the waste will automatically fall into the disposable bag.

(j) Once the disposable bag 2 is full, unlock the clamp 5 by placing a finger or thumb on the extended tab 3.

(k) Press the tab 3 in an upward and outward motion, until the two ends of the clamp have separated.

(l) After disposing of the disposable bag 2, place another bag 2 over the extended rim at the rear of the scooping tray 20.

(m) Align the notched out area 1 of the disposable bag 2 and place it around the hinge 4 area of the bag holding clamp 5.

(n) Squeeze the two ends of the clamp 5 together until they have locked together.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

Accordingly, the reader will note that the scooping device of the present invention provides a convenient and sanitary way for disposing of animal waste. The user is not hampered with trying to find a disposal area, and does not have to worry about the waste falling out of the tray once it has been collected. Furthermore, the present invention has additional advantages. This invention can be manufactured in any size or shape to accommodate tall or short people. This device can be manufactured so that the disposable bag covers the entire scooping tray. The scooping tray can be manufactured in any size or shape to accommodate large or small animals. Additional advantages associated with the present invention include the following:

(a) It provides a secure area for the waste when running or jogging.

(b) It allows the user to enjoy his or her walk with his or her animal by eliminating the need to immediately locate a disposal area.

(e) It can be used in veterinarian hospitals.

(d) It can be used by private or professional dog breeding kennels.

(e) It can be used by professional or private dog walkers.

(f) It can be used by employees of dog breeding shows.

(g) It can be used at K-9 dog training schools.

(h) It can be used by mobile dog grooming services.

Although exemplary embodiments of the invention have been shown and described, many other changes, modifications and substitutions, in addition to those set forth in the above paragraphs, may be made by one having ordinary skill in the art with out necessarily departing from the spirit and scope of this invention.

What is claimed is:

1. A waste collector, comprising:

a scooping tray having a leading portion, an intermediate portion, and a trailing portion;

an outer shaft having a proximal end, a distal end, and an outer shaft axis extending therebetween, the outer shaft being attached to the scooping tray at the intermediate portion;

an inner shaft slidably disposed within the outer shaft, the inner shaft having an inner shaft axis which is substantially parallel to the outer shaft axis, the inner shaft being attached to the scooping tray at the leading portion; and a disposable bag connected to the trailing portion of the scooping tray;

wherein the leading portion of the scooping tray is adapted to pivot about the intermediate portion, to thereby raise the intermediate portion of the scooping tray above the trailing portion of the scooping tray, whereby pivoting of the scooping tray transports waste on the scooping tray into the disposable bag.

2. The waste collector as set forth in claim 1, and further comprising a locking device for preventing movement of the inner shaft relative to the outer shaft, whereby the locking device can be used to hold the scooping tray in raised position.

3. The waste collector as set forth in claim 2, wherein the locking device comprises a button extending through an aperture in the outer shaft and having a portion for pressing against the inner shaft to prevent it from moving relative to the outer shaft.

4. The waste collector as set forth in claim 3, wherein the button is spring-biased outward through the aperture and away from the inner shaft so as to permit the inner shaft to move relative to the outer shaft when the button is not depressed.

5. The waste collector as set forth in claim 1, and further comprising a rake removably secured to the outer shaft.

6. The waste collector as set forth in claim 1, wherein both the inner shaft and the outer shaft are made of plastic, and the scooping tray is made of aluminum.

7. The waste collector as set forth in claim 1, wherein the scooping tray includes a base portion, two upstanding sidewalls, and a top wall, and wherein the outer shaft pivotally attaches at pivot points to both the sidewalls at the intermediate portion thereof, the pivot points being located such that the scooping tray pivots from its own weight to the position where the intermediate portion is above the trailing portion.

8. The waste collector as set forth in claim 7, further including a pair of divergent holding arms provided on the distal end of the outer shaft, each arm attaching to a respective one of the two sidewalls.

9. The waste collector as set forth in claim 7, wherein the inner shaft attaches to the top wall of the scooping tray at a point that is between the leading edge of the scooping tray and the pivot points, such that the inner shaft translates upward within the outer shaft when the scooping tray pivots from its own weight to the position where the intermediate portion is above the trailing portion.

10. The waste collector as set forth in claim 1, further including a hinged clamp surrounding the trailing portion for releasably connecting the disposable bag thereto.

11. An animal waste collector, comprising:

a scooping tray having a receiving window at a leading portion, an intermediate portion having a channel leading from the receiving window, and a trailing portion having a discharge window, the tray thus defining an open pathway from the receiving window to the discharge window;

a pair of poles attached to the scooping tray that function together as an operating handle, a first one of the poles being pivotally connected to the intermediate portion of the scooping tray in a location whereby the tray pivots under its own weight so that the pathway is substantially vertical with the discharge window facing downward, and a second one of the poles being pivotally connected to the scooping tray at a location other than the axis about which the first pole pivots, at least a portion of the second pole being concentrically disposed and slidable within the first pole;

a lock on the operating handle to prevent relative sliding of the first and second poles, and thus prevent pivoting of the scooping tray; and a disposable bag connected to the discharge window at the trailing portion of the scooping tray, wherein a user operates the waste collector by first placing the scooping tray in contact with the ground and allowing it to pivot such that the pathway is substantially horizontal with the receiving window against the ground, depositing waste through the receiving window, and lifting the operating handle whereby the scooping tray pivots under its own weight and the pathway becomes substantially vertical with the discharge window facing downward and the waste falling into the disposable bag.

12. The waste collector as set forth in claim 11, and further comprising a rake removably secured to the first pole.

13. The waste collector as set forth in claim 11, wherein the lock comprises a button extending through an aperture in the first pole where the first and second poles are concentrically arranged, and having a portion for pressing against the second pole to prevent it from sliding relative to the first pole.

14. The waste collector as set forth in claim 13, wherein the button is spring-biased outward through the aperture and away from the second pole so as to permit the second pole to slide relative to the first pole when the button is not depressed.

15. The waste collector as set forth in claim 11, wherein both the second pole and the first pole are made of plastic, and the scooping tray is made of aluminum.

16. The waste collector as set forth in claim 11, wherein the scooping tray includes a base portion, two upstanding sidewalls, and a top wall, and wherein the first pole pivotally attaches at pivot points to both the sidewalls at the intermediate portion thereof, the pivot points being located such that the scooping tray pivots under its own weight and the pathway becomes substantially vertical with the discharge window facing downward.

17. The waste collector as set forth in claim 16, further including a pair of divergent holding arms provided on the distal end of the first pole, each arm attaching to a respective one of the two sidewalls.

18. The waste collector as set forth in claim 16, wherein the pivot points comprise mechanical swivels.

19. The waste collector as set forth in claim 16, wherein the second pole attaches to the top wall of the scooping tray at a point that is between the leading edge of the scooping tray and the pivot points, such that the second pole translates upward within the first pole when the scooping tray pivots under its own weight and the pathway becomes substantially vertical with the discharge window facing downward.

20. The waste collector as set forth in claim 11, further including a hinged clamp surrounding the discharge window for releasably retaining the disposable bag thereto.

* * * * *